United States Patent [19]

Braithwaite

[11] 4,255,899

[45] Mar. 17, 1981

[54] ACTUATORS

[75] Inventor: Philip Braithwaite, Strensham, England

[73] Assignee: Tungum Hydraulics Limited, Cheltenham, England

[21] Appl. No.: 77,595

[22] Filed: Sep. 21, 1979

[30] Foreign Application Priority Data

Sep. 21, 1978 [GB] United Kingdom ..... 37582/78

[51] Int. Cl.[3] ..... E05F 15/20

[52] U.S. Cl. ..... 49/2; 49/31

[58] Field of Search ..... 49/2, 31; 160/6

[56] References Cited

U.S. PATENT DOCUMENTS

| | | | |
|---|---|---|---|
| 1,412,822 | 4/1922 | Applin et al. | 49/2 |
| 2,117,529 | 5/1938 | Wile et al. | 49/2 X |
| 2,751,154 | 6/1956 | Valterson et al. | 236/35.2 |
| 3,103,158 | 9/1963 | Noll | 49/2 |
| 3,210,003 | 10/1965 | Quinton | 49/2 X |

*Primary Examiner*—Kenneth Downey

*Attorney, Agent, or Firm*—Young & Thompson

[57] ABSTRACT

A thermally sensitive actuator for opening and closing a louvre window of the type in which the louvre blades are mounted fast with bell-cranks having their free ends pivotally connected to an operating member which has a pivotal link coupled thereto. The thermally sensitive actuator comprises a housing for mounting on the frame of the window and containing a channel of uniform cross-section having a block slideably mounted therein, and a piston and cylinder assembly, the cylinder of which contains a thermally expansible flowable material and is mounted on the housing with the piston in engagement with the slideable block so that expansion of the flowable material causes displacement of the block. The side walls of the housing contain elongate slots through which projects a pivot pin which is movable in an oblique slot in said block and has connecting means on its projecting end for attachment to the pivotal link of the louvre window.

7 Claims, 2 Drawing Figures

ACTUATORS

BACKGROUND OF THE INVENTION

This invention relates to actuators, and more particularly to thermally sensitive actuators, for opening and closing louvre windows.

In a conventional manually openable louvre window, each of the separately pivoted louvre blades is mounted fast with a bell-crank, the free ends of the bell-cranks being pivotally coupled to a common operating member which, as the louvre blades open and close, remains parallel to the line joining the louvre blade pivot points, thus performing a parallelogram-type movement. This operating member is coupled by a pivotal link to a manually operable lever, the overall arrangement being such that, as the louvre blades move into their closed position, the mechanism behaves as an over-centre toggle to secure the louvre blades in their fully closed position.

SUMMARY OF THE INVENTION

According to the invention, there is provided a thermally sensitive actuator for opening and closing a louvre window of the type in which the louvre blades are mounted fast with bell-cranks having their free ends pivotally connected to an operating member which has a pivotal link coupled thereto, said thermally sensitive actuator comprising a housing for mounting on the frame of the window and containing a channel of uniform cross-section having a block slideably mounted therein, and a piston and cylinder assembly, the cylinder of which contains a thermally expansible flowable material and is mounted on the housing with the piston in engagement with the slideable block so that expansion of the flowable material causes displacement of the block, a side wall of the housing containing an elongate slot through which projects a pivot pin which is coupled to said block and has connecting means on its projecting end for attachment to the pivotal link of the louvre window.

Thus, in use, as the temperature rises, the flowable material in the cylinder expands, displacing the piston outwardly and thereby causing the block to slide along the channel in the housing and the pin to slide along the slot. The resulting linear movement is transmitted by the pivotal link to the operating member to open the louvre blades of the window.

The housing preferably includes two opposed side walls between which said block is slideable, said side walls being formed with similar opposed registering elongate slots through which said pivot pin projects. The block may be fast with the piston so as to be drawn back to close the louvre blades as the temperature falls. Alternatively, the block may be spring biased against the piston so that the biasing springs cause closure of the louvre blades upon withdrawal of the piston into the cylinder.

In a preferred form of the invention, the end portion of the slot occupied by the pin when the louvre blades are in their closed position is cranked at an angle greater than 90° to the rest of the slot. For example, said end portion of the slot may be cranked at such an angle to the rest of the slot as to be perpendicular to the direction of the pivotal link when the louvre blades are closed. The pivot pin may be disposed in an oblique slot in the slideable block so that, for the first part of the movement of the block as temperature increases, the pin is displaced relatively to the oblique slot and in the above-mentioned end portion of the slot in the housing without causing any significant movement of the operating member. Only when the pin has come into alignment with the main part of the elongate slot in the housing does opening of the louvre blades commence. This arrangement thereby effectively locks the louvre blades in their closed position in a similar manner to the toggle catch of the known manually openable louvre windows referred to above.

Preferably the cylinder of the piston and cylinder assembly is mounted on the housing so as to be adjustable longitudinally relative thereto.

DETAILED DESCRIPTION OF THE PREFERRED EMBODIMENT

Figure 1:
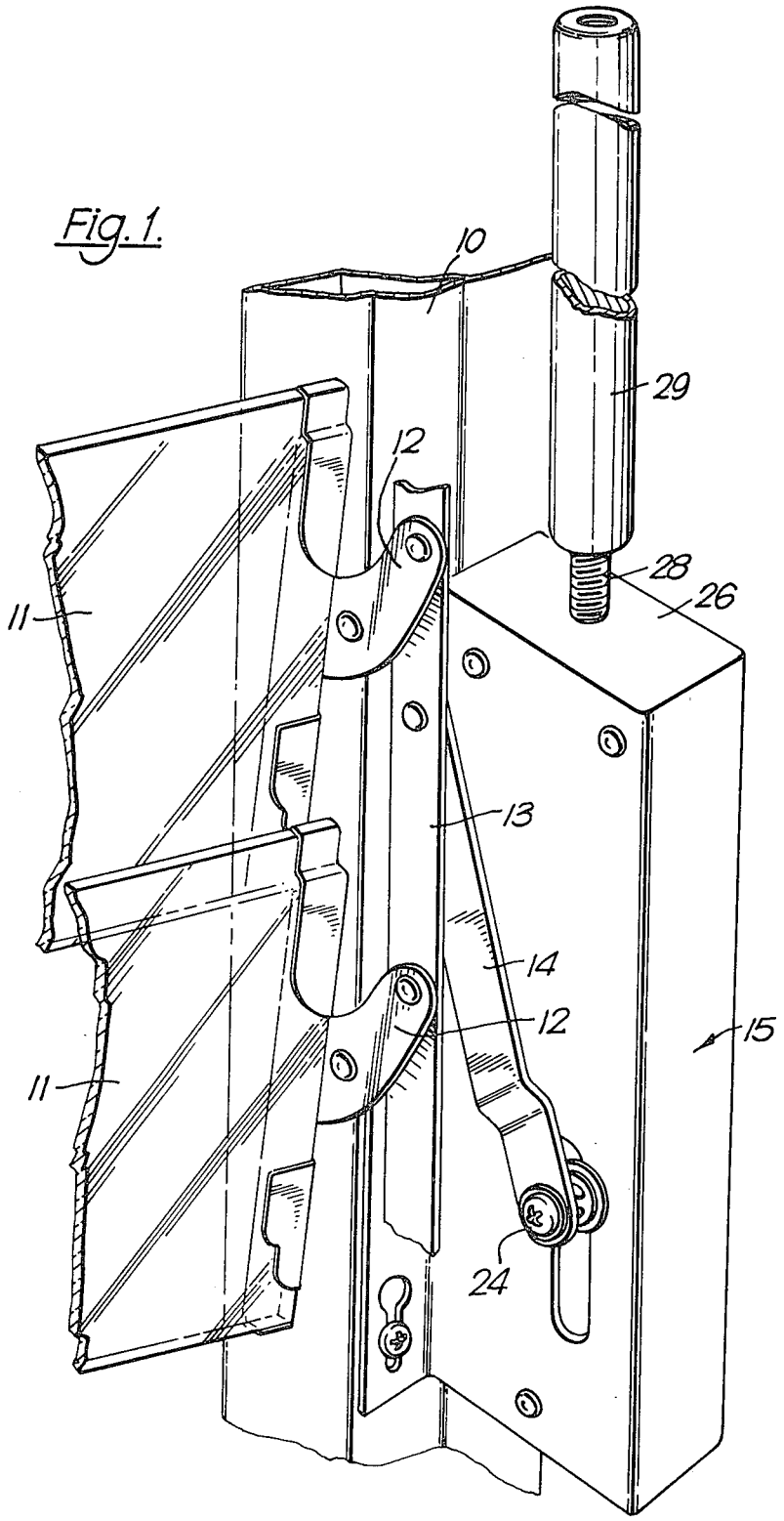
FIG. 1 is a perspective view of a portion of a louvre window fitted with an actuator in accordance with the invention.

Referring to the drawings, the opening in a window frame 10 is covered, in known manner, by a plurality of louvre blades 11 (only two of which are shown) each of which is mounted, at opposite ends thereof, on a respective pair of pivoted bell-cranks 12, only the bell-crank at one end of each louvre being shown in FIG. 1. The bell-cranks 12 on one side of the window are coupled together by an operating member 13 while the bell-cranks (not shown) on the other side of the window are coupled together by a similar operating member (also not shown). The operating member 13 is coupled by a pivotal link 14 to an actuator 15, as will be described hereinafter. The operating member at the other side of the window merely serves to distribute uniformly between the louvre blades any load tending to twist one or other of the blades.

Figure 2:
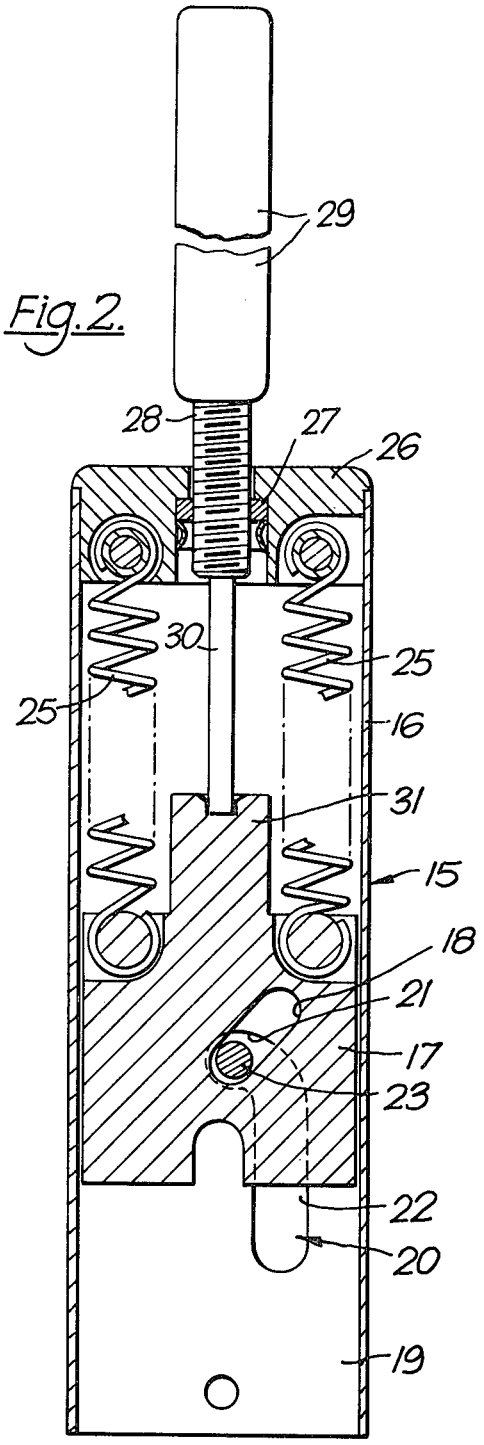
FIG. 2 is a cross-sectional view of the actuator shown in FIG. 1.

Referring to FIG. 2, the actuator 15 comprises a housing 16 containing a channel of rectangular cross-section in which a slideable block 17 is located. The block 17 has a diagonal slot 18 extending therethrough while the side walls 19 of the housing 16 have opposed registering elongate slots 20 (only one of which may be seen in FIG. 2) extending in the direction of sliding movement of the block 17 in the housing 16. The upper end portion 21 of each of the slots 20 is cranked at more than 90° to the direction of the rest of the slot 22. For example, the portion may be cranked at 98½° to the rest of the slot. A pivot pin 23 extends through all three slots 18, 20 and has a tapped hole in one end for receiving a screw 24 (FIG. 1) whereby the pin 23 is pivotally connected to the pivotal link 14. The angle at which the end portions 21 of the slots 20 are cranked is such as to be perpendicular to the direction of the pivotal link 14 when the window is fully closed.

The slideable block 17 is coupled by two tension springs 25 to an end closure member 26 which projects into and closes the upper end of the housing 16. The closure member 26 has a central threaded nut 27 located therein into which is screwed a male threaded end portion 28 of a pressure cylinder 29. The cylinder 29 contains a mass of flowable material such as a wax having a high coefficient of thermal expansion and a piston 30 projects therefrom through the threaded portion 28 and into engagement with a recess in an abutment member 31 formed at one end of the slideable block 17.

FIG. 2 shows the piston 30, block 17 and pivot pin 23 in the position which they occupy when the window is fully closed but the ambient temperature is such that any increase in temperature will cause the opening movement to begin. As the temperature rises, the piston 30 projects further from the cylinder 29 displacing the slideable block 17 downwardly as viewed in FIGS. 1 and 2. The cranked ends 21 of the slots 20 prevent any similar downward movement of the pivot pin 23 which therefore moves transversely in the slot 18 until it has been displaced to the right into alignment with the main longitudinal parts 22 of the slots 20, as seen in FIG. 1. This transverse displacement of the pivot pin 23 causes a slight angular movement of the pivotal link 14 but no linear displacement thereof.

A further rise in temperature causes the movement of the block 17 along the channel within the housing 16 to continue and, at this stage, the pivot pin 23 moves downwardly along the portions 22 of the slots 20. The linear movement of the pin 23 is transmitted by the pivotal link 14 to the operating member 13 and the resulting angular movement of the bell-cranks 12 causes the louvre blades 11 to open. When the louvre blades are fully open, the pivot pin 23 abuts against the bottom ends of the slots 20 and the expansion resulting from any further rise in temperature is accommodated by the end closure 26 being pushed upwardly as viewed in FIG. 2, against the action of the springs 25.

When the ambient temperature falls, the piston 30 is drawn back into the cylinder 29 and the block 17 is drawn upwardly by the springs 25. The louvre blades 11 close, following the reverse procedure to that described for the opening movement, and the pivot pin 23 reverts to the position shown in FIG. 2 in which the window is locked in its closed position. Any further fall in temperature causes the piston 30 to move out of contact with the abutment member 31.

The threaded portion 28 on the cylinder 29 allows the position of the latter relative to the end closure member 26 to be adjusted, thereby varying the temperature at which the window starts to open.

If it is desired to lock the window in its closed position, the cylinder 29 can be screwed right out of the end closure member 26 and removed. The cooperation of the crank end portions 21 of the slots 20 with the pin 23, under the action of the springs 25, then ensures that the window cannot be opened.

I claim:

1. A thermally sensitive actuator for opening and closing a louvre window of the type in which the louvre blades are mounted fast with bell-cranks having their free ends pivotally connected to an operating member which has a pivotal link coupled thereto, said thermally sensitive actutator comprising: a housing for mounting on the frame of the window having at least one side wall and containing a channel of uniform cross-section; a block slideably mounted in the channel; and a piston and cylinder assembly, the cylinder of which contains a thermally expansible flowable material and is mounted on the housing with the piston in engagement with the slideable block so that expansion of the flowable material causes displacement of the block, the side wall of the housing containing an elongate slot through which projects a pivot pin which is coupled to said block and has connecting means on its projecting end for attachment to the pivotal link of the louvre window.

2. A thermally sensitive actuator according to claim 1, wherein the housing includes two opposed side walls between which said block is slideable, said side walls being formed with similar opposed registering elongate slots through which said pivot pin projects.

3. A thermally sensitive actuator according to claim 1, further comprising springs biasing the block against the piston so that the biasing springs cause closure of the louvre blades upon withdrawal of the piston into the cylinder.

4. A thermally sensitive actuator according to claim 1, wherein the elongate slot has an end portion occupied by the pin when the louvre blades are in their closed position, which end portion is cranked at an angle greater than 90° to the rest of the slot.

5. A thermally sensitive actuator according to claim 4, wherein said end portion of the slot is cranked at such an angle to the rest of the slot as to be perpendicular to the direction of the pivotal link when the louvre blades are closed.

6. A thermally sensitive actuator according to claim 5, wherein the pivot pin is disposed in an oblique slot in the slideable block so that, for the first part of the movement of the block as temperature increases, the pin is displaced relatively to the oblique slot and in the above-mentioned end portion of the slot in the housing without causing any significant movement of the operating member.

7. A thermally sensitive actuator according to claim 1, wherein the cylinder of the piston and cylinder assembly is mounted on the housing so as to be adjustable longitudinally relative thereto.

* * * * *